US005152075A

United States Patent [19]

Bonar

[11] Patent Number: 5,152,075

[45] Date of Patent: Oct. 6, 1992

[54] DRYING OF CLOTHES BY ELECTROLYSIS

[76] Inventor: George D. Bonar, G.P.O. Box 2064, New York, N.Y. 10116

[21] Appl. No.: 766,095

[22] Filed: Sep. 27, 1991

[51] Int. Cl.[5] ..... F26B 3/34

[52] U.S. Cl. ..... 34/1 H; 34/1 E; 34/60; 204/213; 204/270; 204/129

[58] Field of Search ..... 34/1 E, 1 H, 60, 1 J, 34/68, 12; 204/213, 270, 277, 278, 129, 228, 258

[56] References Cited

U.S. PATENT DOCUMENTS

| | | | |
|---|---|---|---|
| 1,040,370 | 10/1912 | McDorman | 204/213 |
| 1,059,071 | 4/1913 | Robinson | 204/213 |
| 1,086,579 | 2/1914 | Bess | 204/213 |
| 1,167,594 | 1/1916 | Porter | 204/213 |
| 3,543,408 | 12/1970 | Candor et al. | 34/1 E |
| 4,457,816 | 7/1984 | Galluzzo et al. | 204/270 |

*Primary Examiner*—Henry A. Bennet
*Assistant Examiner*—Denise L. F. Gromada
*Attorney, Agent, or Firm*—John B. Dickman, III

[57] ABSTRACT

A clothing drying apparatus using electrolysis to remove moisture from the clothing where there are cathode and anode electrodes mounted in a rotating drum. Air is circulated through the drum to remove moisture and hydrogen and oxygen gases produced by the electrolysis.

3 Claims, 1 Drawing Sheet

DRYING OF CLOTHES BY ELECTROLYSIS

BACKGROUND OF THE INVENTION

This invention relates to a clothes drying apparatus, and in particular to clothes drying apparatus which operates in whole or in part using electrolysis to remove water from clothing.

Although clothes drying apparatus have been known heretofore, it has been found that in most home environments that gas or electric dryers are most common. However it is not forgotten that the outdoor, or sometimes indoor, clothes line in combination with solar heat and wind has been used for centuries. Demands on gas supplies, generally natural gas or propane gas, and rising costs in the industry are making gas dryers less cost efficient. Likewise, electrical dryers suffer from the increased demand for electricity, and the fact that electric companies offer rebates for energy saving methods. It is, therefore important to develope alternative methods for reducing both natural gas and electricity consumption.

Prior electrical clothes dryers operate on either 120 v or 240 v. The basic clothes dryer is provided with a rotating drum and circulating hot air is produced by forcing air over an electrically heated coil element. The heated air mixes with the tumbling clothes in the rotating dryer to remove moisture. A clothes dryer is constructed like a clothes washer which uses a drum and an agitator where one or the other reciprocates to agitate the clothes in soapy water. It is possible to adapt the apparatus of a clothes washer for use as a clothes dryer which could reduce the number of apparatuses needed, and, in addition, the demand for space would be about half. The applicant is aware of various electrolysis apparatuses, however, to the applicant's knowledge there have not been any prior showings of the use of electrolysis to remove moisture from clothing.

SUMMARY OF THE INVENTION

The present invention provides an alternative source of energy for operating a clothes dryer. Briefly, the invention includes an apparatus for removing moisture from clothing. The apparatus is provided with a rotating drum mounted in a housing. A plurality of electrodes are mounted inside the drum with half of the electrodes connected to one end of the drum, the other half are connected to the other end. The electrodes are half cathode and the other half anodes with the cathodes alternating with anodes around the inside of the drums. The electrodes are connected to a source of direct current to separate water into hydrogen and oxygen gases.

If needed, heated air produced by heating air with natural gas or electricity may be used to supplement the drying process. There may be a point where the electrolysis becomes inadequate to remove moisture, at which point sensors in the apparatus would shut off the direct current and switch on the natural gas or electricity.

In case the dryer apparatus is incorporated in a washing apparatus, it will be a provision that the direct current, natural gas and alternating current electricity will be shut off when the washer is operational.

It is the primary object of the improved dryer apparatus to provide an efficient clothes dryer which employs electrolysis to remove moisture.

It is a further object of the improved dryer apparatus to provide a clothes dryer that is less expensive to operate.

It is another object of the improved dryer apparatus to provide a combination washer and dryer apparatus.

DESCRIPTION OF THE INVENTION

Figure 1:
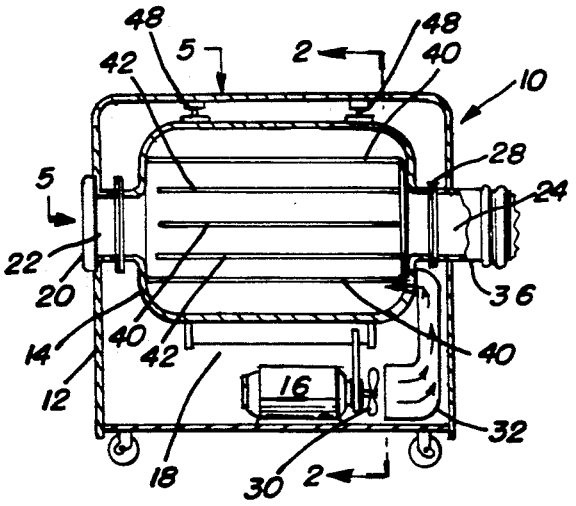
FIG. 1 is a side plan view of a clothes dryer according to the present invention.

Referring to FIG. 1, there is shown a clothes dryer 10 including a housing 12 and a rotating drum 14. An electric motor 16 is connected to the drum 14 by a pulley system 18 to rotate the drum. A conventional dryer door 20 seals opening 22 at one end of the drum 14, while the other end of the drum has an opening 24 that exhausts moist air and lint from the apparatus 10. There are a pair of rotary seals 26 and 28 to seal the edges of the drum 14.

Figure 2:
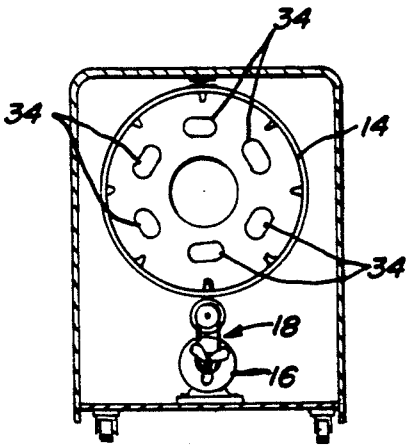
FIG. 2 is a cross sectional view taken along the line 2—2 of FIG. 1.

The electric motor 16 is provided with a propeller 30. Air is drawn into an air duct 32 by the propeller 30 and pushed through the duct 32 to air inlets 34, FIG. 2, of rotary drum 14. The air circulates around the clothes in the drum 14 picking up moisture and carrying it out through opening 24 and vent 36. The vent 36 will usually have a filter to trap lint to prevent it from being exhausted into the atmosphere.

Figure 3:
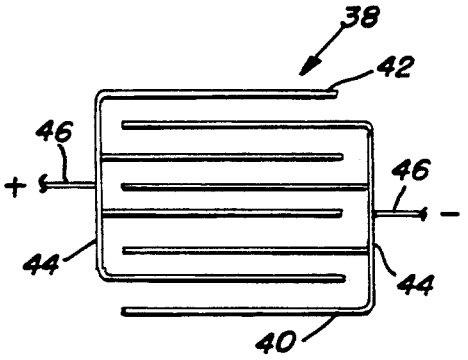
FIG. 3 is a schematic of a direct current electrode arrangement of the present invention.
Figure 4:
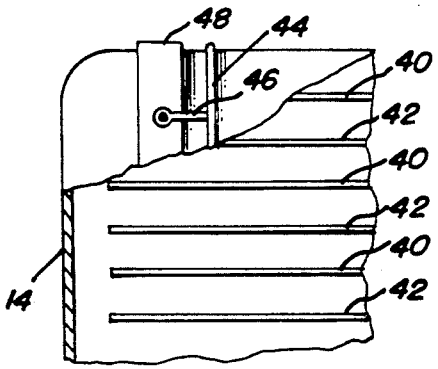
FIG. 4 is a partial plan view of a rotary drum of the present invention.

FIGS. 2 through 5 show electrodes 38, FIG. 3, divided into half cathodes 40 and half anodes 42. The cathodes 40 and anodes 42 are wrapped around the inside of the drum 14 with the free ends of the electrodes 38 extending across the drum, as in FIGS. 1 and 4. In FIG. 3, the cathode rods 40 and anode rods 42 are alternated to have cathode, anode, cathode, etc. The attached ends of the electrodes 38 connect to connecting electrodes 44 with leads 46 that connect to circular bus bars 48, FIGS. 1, 4 and 5. Each of the bus bars 48 is an electrically conductive metal, such as copper, that connects to one of the leads 46. FIG. 4 shows one of the connecting electrodes 44 and a lead 46 on the outside of the drum 14. The other bus bar 48 is mounted on the other end of drum 14. It is important that the bus bars 48 be insulated from the drum 14. Drum 14 has inwardly directed dividers 50 to separate the cathodes 40 from anodes 42 so as to separate the electrolysis action on the different electrodes 38.

Figure 5:
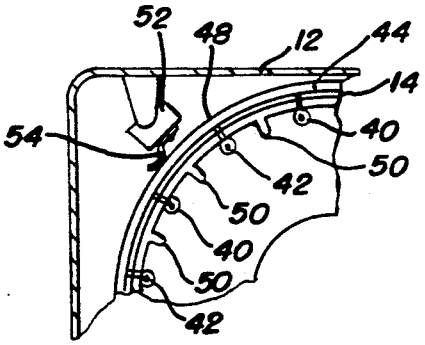
FIG. 5 is a partial cross sectional view taken along the line 5—5 of FIG. 1.

The bus bar 48 in FIG. 5 is connected by an electrical contact 52 to a source of direct current. Contact 52 has a feeler 54 which rubs on the surface of the bus bar 48, transferring direct current to the electrodes.

In use, the drying apparatus 10 is filled with clothes and the electric motor 16 is started to rotate the drum 14. Direct current is switched on to send current through cathodes 40 and anodes 42. Any water in the drum 14 or in the clothing is disassociated into hydrogen and oxygen gases that are carried out of the drum 14 through vent 36. As the moisture is driven out of the clothing the electrolysis action is reduced perhaps to the point that no more moisture is removed. If the clothing is dry the apparatus 10 is shut off. However, if the clothing is still damp, the direct current is turned on. Current is passed through heating coil element 60, FIG. 1, to heat the air, thereby finishing the drying process.

The source of direct current is not shown, however, there are several sources for producing direct current known in the prior art. Therefore, any inexpensive source will do.

Figure 6:
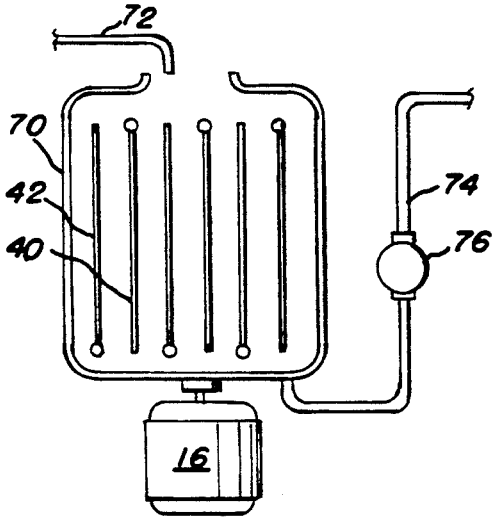
FIG. 6 is another embodiment of the present invention.

FIG. 6 shows a washer drum 70 with the agitator removed to show electrodes 38. Electrodes 38 are cathodes 40 and anodes 42, similar to the electrodes in drum 14. Either the agitator or drum 70 oscillates to agitate the clothes and soapy water. There is a water fill tube 72 and a water removal tube 74. A water pump 76 draws the water from the drum. Once a majority of the water is removed, the washer is turned off and direct current is turned on. Air is forced into the drum 70 as in drum 14, if necessary the air can be heated to finish the clothes drying. The difference in drum 70 and drum 14 is that drum 70 is rotated about the vertical, while in drum 14 it rotates horizontally.

It will, of course, be understood that various changes may be made in form, details and proportions of the various parts without departing from the scope of the invention.

I claim:

1. A clothes drying apparatus for removing moisture from the clothing, comprising;

a housing;

a rotating drum in said housing for holding clothing;

a means to rotate said drum;

a plurality of electrodes mounted in said rotating drum connected to a source of direct current;

said electrodes being arranged to provide alternating cathodes and anodes to produce hydrogen and oxygen gases from the water contained in said drum and clothing in said drum, where moisture is removed from the clothing, said rotating drum is provided with forced air to mix with the moisture and hydrogen and oxygen gases and remove the moisture and gases from said rotating drum, where a conduit is connected at one end to said drum and to a means to force air through said conduit into said drum.

2. A clothing drying apparatus as in claim 1 wherein a heating means is provided in said conduit to heat the air entering said rotating drum when said direct current is shut off.

3. A clothing drying apparatus as in claim 2 wherein said rotating drum is provided with a plurality of dividers to separate the electrodes from each other thereby aiding the electrolysis process.

* * * * *